US005127862A

United States Patent [19]

Pia

[11] Patent Number: 5,127,862

[45] Date of Patent: Jul. 7, 1992

[54] WATER CRAFT

[76] Inventor: Francesco A. Pia, 3 Boulder Brae La., Larchmont, N.Y. 10538

[21] Appl. No.: 642,048

[22] Filed: Jan. 15, 1991

[51] Int. Cl.[5] ..... A63C 15/00

[52] U.S. Cl. ..... 441/79; 441/65; 441/74; 114/39.2

[58] Field of Search ..... 114/39.1, 39.2, 56, 114/57, 61, 123; 441/65, 74, 75, 79

[56] References Cited

U.S. PATENT DOCUMENTS

| | | | |
|---|---|---|---|
| 3,289,227 | 12/1966 | Kelly | 441/74 |
| 3,807,337 | 4/1974 | English et al. | 114/56 |
| 4,194,458 | 3/1980 | Messing | 114/39.2 |
| 4,856,445 | 8/1989 | Kiper | 114/39 |
| 4,857,025 | 8/1989 | Brown et al. | 441/74 |
| 4,886,476 | 12/1989 | Brocone et al. | 441/74 |
| 4,894,035 | 1/1990 | Pia | 441/74 |

FOREIGN PATENT DOCUMENTS

| | | | |
|---|---|---|---|
| 0119747 | 9/1984 | European Pat. Off. . | |
| 0170339 | 2/1986 | European Pat. Off. . | |
| 3048331 | 7/1982 | Fed. Rep. of Germany | 114/39.2 |
| 2525482 | 10/1983 | France . | |

*Primary Examiner*—Jesus D. Sotelo
*Assistant Examiner*—Stephen P. Avila
*Attorney, Agent, or Firm*—Francis C. Hand

[57] ABSTRACT

The water craft is provided with a longitudinally disposed recess in the deck with a pair of ridges defining the recess and extending along the sides of the craft. Each ridge is rounded with respect to a centrally disposed rounded crown in the recess so as to provide a surface against which a windsurfer may stand during windsurfing. The ridges are also more gently rounded with respect to the crown in a stern section of the craft to provide for a comfortable seating arrangement for sailing or rowing purposes. The underside of the craft is provided with a pair of runners along the longitudinal edges and a centrally disposed chines. In addition, a winglet extends from the terminal rear end of each runner in order to enhance stability of the craft in water and to direct water out the sides of the stern during sailing.

29 Claims, 3 Drawing Sheets

WATER CRAFT

This invention relates to a water craft. More particularly, this invention relates to a water craft which is useful as a multi-purpose recreational craft and as a marine rescue craft.

Heretofore, various types of water craft have been known for use in rescue work as well as in recreational activities, for example, water craft such as surf boards and paddle boards have been used not only for rescue work but also for recreational purposes. By way of example, one such type of water craft is described in U.S. Pat. No. 4,894,035.

Generally, water crafts have been constructed with features which are specially adapted for specific uses. For example, paddle boards have been fabricated with a pointed bow which is to be angled out of the water as well as with a convex underwater surface in order to achieve faster speeds when in use. In other cases, boards have been made with a concave underwater surface in order to provide lateral stability.

Where a surf board has been intended for use as a sail board, the length is increased, a center board is inserted and means for attaching a pivoting sail to be supported by a sailor has been added. For speed or racing sail boarding, the length of the craft is shortened and the displacement of the sail board reduced to less than the weight of the sailor.

Where a craft has been designed for use as a kayak, the craft has been made with a generally U-shaped hull with a narrow beam, tapered bow and stern. Specific designs for ocean cruising have entailed slightly widening the craft and increasing the length.

Where a craft has been designed for rowing, the beam of the craft is narrow, the bow and stern sharply tapered and the construction very light. In addition, oar locks have been added to permit insertion of oars while rowing.

Where a craft has been constructed for sailing, the beam of the craft is increased, a thick fixed mast either stayed or unstayed is inserted into the deck, a center board or weighted keel inserted and a rudder added.

Heretofore, individuals wishing to engage in any of these activities were generally forced to purchase separate water crafts for each activity.

Accordingly, it is an object of the invention to provide a single craft which is suitable for multiple recreational uses.

It is another object of the invention to provide a water craft which is suitable for multiple recreational and marine patrol and rescue uses.

It is another object of the invention to provide a water craft of board-like construction which can be readily navigated.

It is another object of the invention to provide a water craft which is capable of being used as a cruising or racing windsurfer, or sailboat.

It is another object of the invention to provide a water craft which can be propelled through the water by hand paddling.

It is another object of the invention a use with the option of using a water craft as a windsurfer, sailboat kayak or rowing craft.

Briefly, the invention provides a water craft which has a bow section shaped and contoured to impart stability when moving through water and a stern section which is shaped and contoured to improve the speed of the craft through the water. The craft is constructed of a hollow body of either one piece buoyant or two piece sandwich foam fiber glass construction.

The water craft has a forward deck section of generally flat shape in the bow section, a recessed deck section in a mid-section between the bow section and stern section and an angularly disposed deck section in the stern section which is directed rearwardly and downwardly relative to the stern section in order to direct a flow of water from the stern section. In addition, a longitudinally disposed crown is disposed within the recessed deck section. This crown is rounded down from a centerline of the craft to assist the placement of feet while windsurfing and to increase the amount of sail being used.

The water craft is also provided with a pair of ridges, each of which extends along a respective longitudinal side of the craft in order to define the recess of the recessed deck section. In this respect, each ridge has a longitudinally disposed section which defines a rounded cross-section of sharp radius with the crown for receiving a heel of a windsurfer. In addition, each ridge has a second longitudinally disposed section defining a rounded cross-section of large radius with the crown for seating of a sailor thereagainst.

The craft also includes a receptacle or track within the recessed deck section for receiving a mast. Thus, when the craft is to be used for windsurfing, a mast of conventional construction is mounted on the craft with the sailor standing with one or both heels against the ridge on one side of the craft. The sharpness of the contour of the ridge relative to the crown provides for stability of the sailor during windsurfing, particularly with the craft biting into the water along one side.

The water craft can be readily used for recreation purposes, for example in the form of a kayak, a paddleboard, a racing or cruising windsurfer, a racing or cruising sail boat, a rowing shell, and a motorized craft. For example, in recreational cases, the craft can be used in the manner of a kayak, that is, propelled through the water with a double bladed paddle, with a mast inserted into the deck of the craft with the sails furled. Where the craft is propelled through the water, an individual may be seated on the top deck of the stern section in a stable manner with his feet braced in the footrests. Such stability greatly surpasses the stability of traditional surfboards where smooth slightly convex undersides render the boards somewhat unstable and easily tippable.

At a time deemed appropriate by the user, the paddles can be unsleeved and inserted into receptacles on either the top side of the bow or stern deck. The sail would then be unfurled and the craft used as a sailboat. In like manner the mast could be removed from the deck of the craft, inserted into the mast foot with a universal joint, and sailed as windsurfer.

Where used as a windsurfer, a mast can be attached to the craft with a universal joint or like means and may be supported in an upright position by the user. Because of the stability of the craft, a novice windsurfer may quickly master the skills necessary to balance oneself on the craft. Thus, instead of concentrating on learning the skills of balancing, the user may concentrate on the skills required for sailing.

The underside of the craft is also constructed in a manner similar to that as described in U.S. Pat. No. 4,894,035. That is, the bow section is upraised and is of parabolic shape with a centrally disposed recess on the underside while a pair of depending runners extend from the bow section into and along the rear stern section. In addition, a depending chine extends centrally of and between the runners in order to define a pair of channels therebetween. The thus defined channels each extend from and communicate with the centrally disposed recess of the bow section in order to guide a flow of water therethrough.

In addition, a pair of winglets is provided on the underside of the water craft. Each winglet extends rearwardly and outwardly from a rear end of a respective runner in order enhance tracking of the water craft in the water by directing a flow of water out a side of the stern section and by penetrating deeper into the water.

In addition to the receptacle for receiving a mast, the craft may also be provided with a means for mounting a steering rudder, for example, in a cutout in the stern section. In addition, a receptacle may also be provided in the deck to receive an adjustable tiller extension which extends from the a head of a rudder. With a sail in place, the craft can be used as a sailboat. In this embodiment, the rounded deck and ridges provide a stable surface on which a user may sit for sailing of the craft. Foot straps may also be provided for bracing the feet while sailing.

Further, a center board blade may be pivotally mounted in the underside of the mid-section of the craft for pivoting into a depending position for sailing purposes.

When the craft is used a wind surfer, the rounded crown permits the user to lean further outward than is possible on a flat deck. This increases the speed of the craft and the amount of sail which may be used.

Further, the craft may also be provided with means for mounting an open or closed cockpit with a seat, foot rests, a back support and outriggers for rowing oars. When used as a rowing shell, the user will place the cockpit on the deck of the watercraft so that the foot rests are facing the stern. The oars would then be inserted into oar locks located on the craft and the craft would be used in the usual manner. When used as a kayak or paddleboard, the cockpit would be placed with the foot rests facing the bow, the oar locks would be removed, the back rest attached and the seat position fixed so that the craft can be propelled in the usual manner.

These and other objects and advantages of the invention will become more apparent from the following detailed description taken in conjunction with the accompanying drawings wherein.

Figure 1:
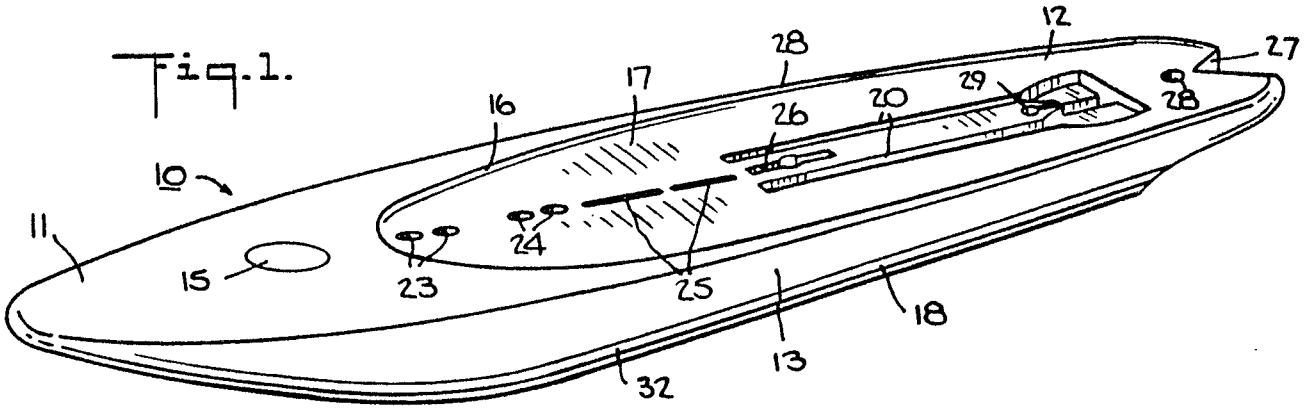
FIG. 1 illustrates a perspective view of a water craft constructed in accordance with the invention.

Referring to FIG. 1, the water craft 10 is of board-like shape, for example having an overall length of about 12 feet and a width about 38 to 39 inches at the widest point. The total weight of the craft is approximately 80 pounds and the craft may be of hollow or solid construction. Further, where hollow the craft may be made of a multi-layer construction formed of a foam sandwich fiber glass construction having two layers of glass fiber, a layer of PVC foam and a further layer of glass fiber.

As illustrated, the water craft 10 has a forward bow section 11, a stern section 12 and a midsection 13. In addition, a substantially continuous deck extends along a longitudinal axis of the craft from the bow end to the stern end of the craft.

Figure 5:
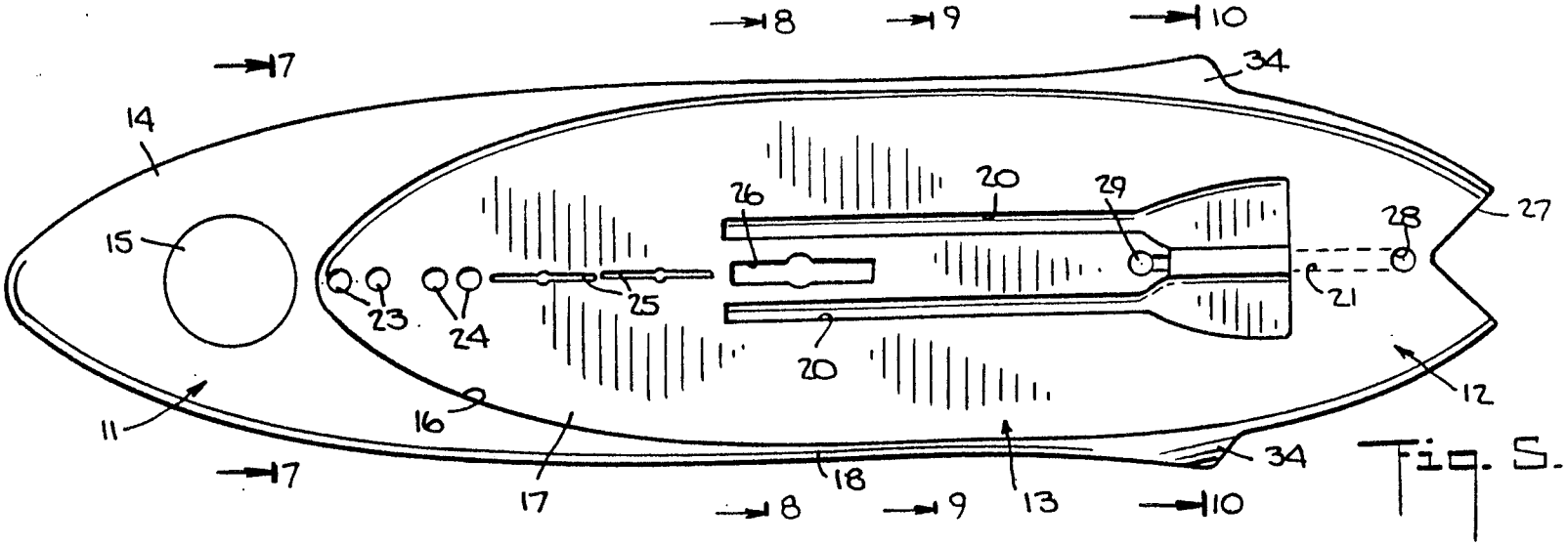
FIG. 5 illustrates a top view of the water craft of FIG. 1.

Referring to FIG. 5, the deck of the craft 10 has a forward deck section 14 of generally flat shape within the bow section 11. In addition, the deck section 14 is provided with an aperture which is covered over by a suitable removable cover 15 so as to provide access to the interior of the bow section. In this way, the interior of the bow section may form a storage and/or inspection compartment.

The deck also has a recessed deck section in the mid-section 13. This recess deck section forms a longitudinally disposed recess 16 which extends from within the bow section to the end of the stern section. In addition, a longitudinally disposed crown 17 is disposed within the recess 16 and extends to the end of the stern section.

Figure 8:
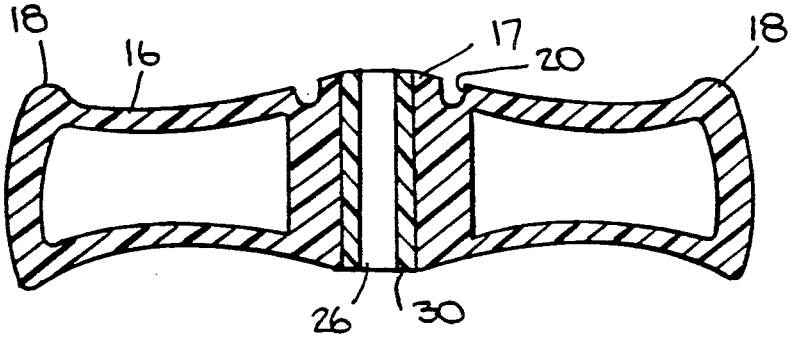
FIG. 8 illustrates a view taken on line 8—8 of a mid-section of the water craft of FIG. 5.
Figure 9:
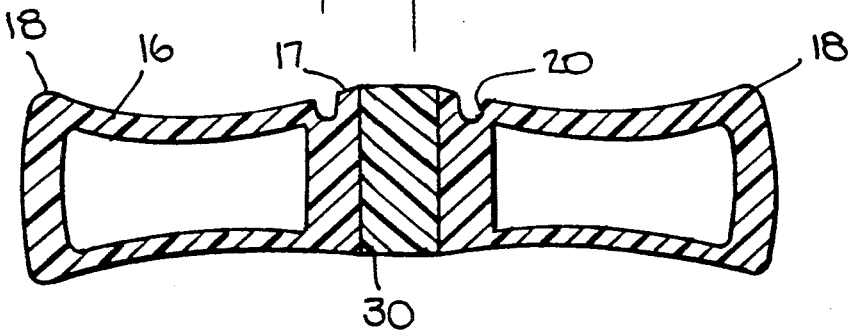
FIG. 9 illustrates a cross sectional view taken on line 9—9 of FIG. 5.
Figure 10:
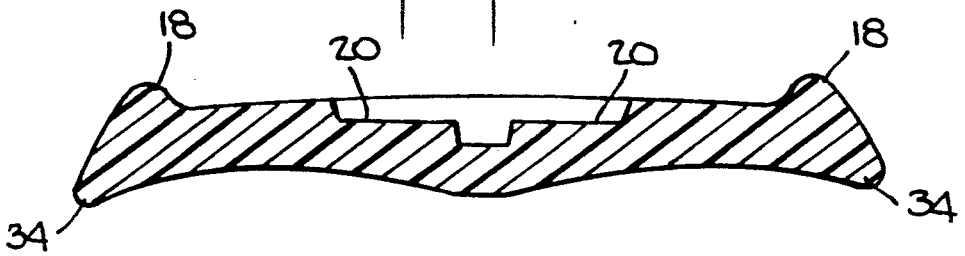
FIG. 10 illustrates a view taken on line 10—10 of FIG. 5 of the winglets at the ends of the runners of the craft in accordance with the invention.

As indicated in FIG. 5, the craft 10 is provided with a pair of ridges 18, each of which extends along a respective longitudinal side of the craft in order to define the recess 16 thereat. The ridges 18 extend peripherally about the recess 16 and merge together at a forward-most point in the bow section 11. As indicated in FIG. 8, each ridge 18 has a longitudinally disposed section which defines a rounded cross section of sharp radius with the crown 17, for example which is sized so as to receive a heel of a wind surfer. In addition, as indicated in FIG. 9, each ridge 18 has a second longitudinally disposed section rearward to the first section which defines a rounded cross-section of large radius with the crown 17 so as to provide for seating of a sailor thereagainst.

Referring to FIGS. 1 and 5, a pair of paddle-shaped recesses 20 are disposed in the crown 17 for receiving a pair of oars (not shown) therein. As indicated, the two recesses 20 are disposed symmetrically of a centerline of the craft 10. Each recess 20 also extends rearwardly to under the deck such that a slot is formed into which an oar can be slid in order to retain the oar in place within the recess 20. In addition, as indicated in FIG. 5, a storage tube 21 is provided below the surface of the deck at the stern section and between the two recesses 20. This storage tube 21 serves to receive a mast extension for storage purposes.

In order to provide for multi-use, the deck of the water craft 10 is provided with two pairs of openings 23, 24 in order to receive the mast. Also, one or two windsurfing tracks 25 are provided within the mid-section 13 of the craft 10 on the centerline of the craft 10. Also, a center board trunk 26 is provided on the centerline of the craft at about a midpoint of the craft in order to receive a center board assembly of generally conventional structure.

As indicated in FIG. 5, the stern section 12 is provided with a V-shaped cut-out 27 and an opening 28 for receiving a rudder assembly mounting arrangement. The shape of the cutout 27 is such as to limit the angular movement of a rudder (not shown) left or right of the centerline.

A recess 29 is also disposed on the centerline of the water craft at a point forward of the storage tube 21 in order receive a receptacle for a tiller extension of a rudder assembly.

Still further, a pair of seat belts (not shown) may be secured in place inside the ridges 18 within the mid-section 13 of the craft 10.

The craft 10 is thus adapted to receive a mast assembly in the tracks 25 for wind sailing purposes, a center board in the center board trunk 26 for sailing purposes, a mast in one of the two sets of openings 23, 24 and a sail tie down (not shown) in the other of the two sets of openings 23, 24. Also, a motor can be mounted on the stern of the craft.

The craft 10 can thus be adapted for windsurfing, sailing, cruising, rowing, kayaking.

When the craft 10 is used in a windsurfing mode, the sailor can place his/her heels against the rounded bridge 18 along one side of the craft while leaning over the side of the craft to increase the speed of the craft.

When the craft 10 is used for sailing or rowing purposes, the sailor can be seated within the stern section in a comfortable manner against the more gently rounded portions of the ridges 18 in the stern section 12.

For purposes of kayaking, the two oars which are placed in storage can be fixed together in known manner to permit the craft to be used in a kayak mode.

Figure 2:
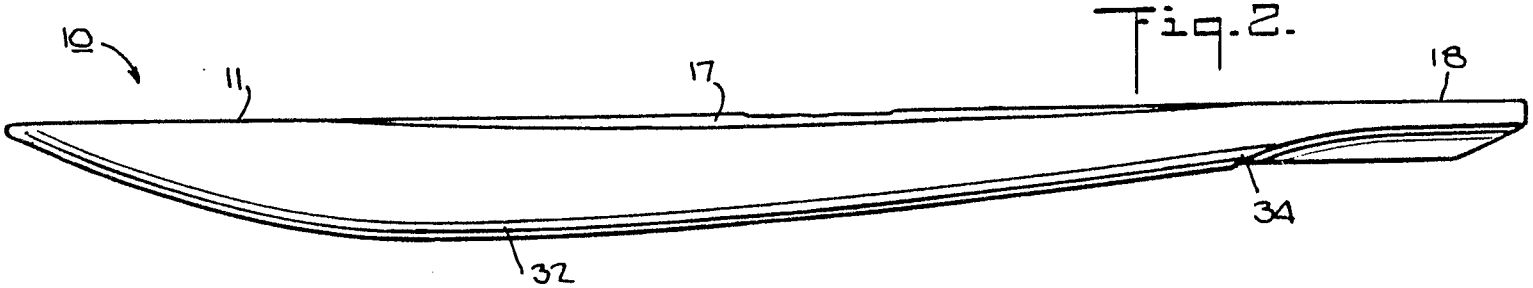
FIG. 2 illustrates a side view of the water craft of FIG. 1.
Figure 4:
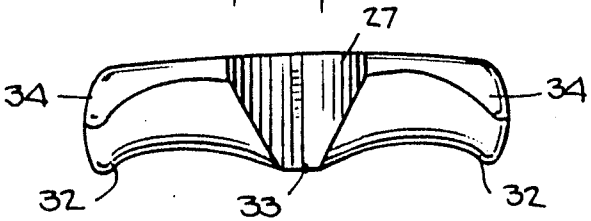
FIG. 4 illustrates a rear view of the water craft of FIG. 1.

As indicated in FIG. 2, the crown 17 projects upwardly out of the plane of the ridges 18 within the mid-section 13 of the craft 10 while dropping below the plane of the ridge 18 at the stern end of the craft. Further, the recess 16 is angularly disposed relative to the bow section 11 such that the rear end of the deck is lower than the forward end of the deck.

Referring to FIGS. 8 and 9, the craft is constructed with a centrally disposed girder 30 which extends along the centerline of the craft 10 from a point slightly forward of the openings 23 for the mast receptacle to the stern section so as to provide for strength and rigidity particularly for the mounting of the various components noted above.

The underside of the craft 10 is constructed in a manner similar to that described in U.S. Pat. No. 4,894,035. That is, the underside of the craft has a centrally disposed recess 31 (see FIG. 3) in the bow section and a pair of depending runners 32 which extend from the bow section into and along the stern section 12. As indicated in FIG. 1, each runner 32 begins at a point slightly to the rear of the point at which recess 16 in the deck section begins.

Figure 6:
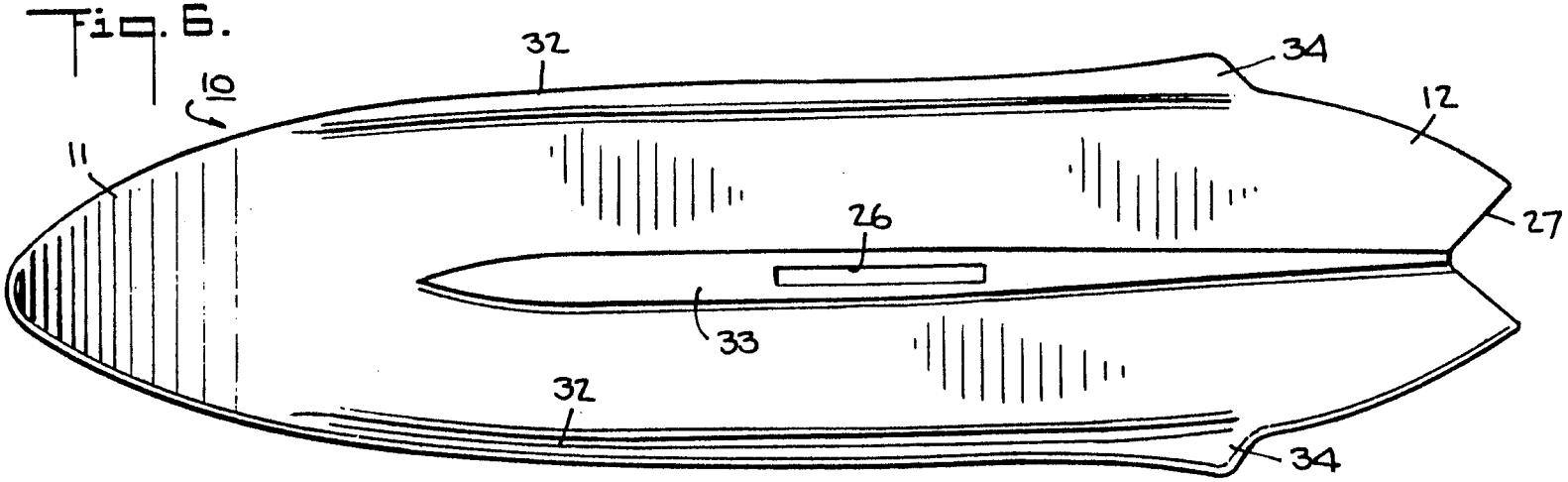
FIG. 6 illustrates a bottom view of the water craft of FIG. 1.
Figure 7:
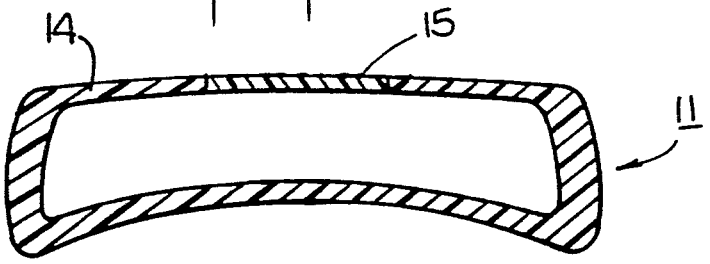
FIG. 7 illustrates a cross sectional view taken on line 7—7 of the bow section of the water craft of FIG. 1.

In addition, the underside of the craft has a depending chine 33 which extends centrally of and between the runners 32. As indicated in FIG. 6, the chine 33 begins at a point to the rear of the beginning of the runners 32.

In addition, each runner 32 terminates in a winglet 34 (see FIGS. 5 and 6) which extends rearwardly and outwardly from the runner 32 in order to direct a flow of water out of the stern section 12 to enhance tracking of the craft in water. In addition, the winglets enhance tracking of the craft by penetrating deeper into the water, thus penetrating small waves rather than skipping over them.

The recess 31 of the bow section is sized and shaped so as to channel water under the craft and between the runners 32. The chine 33 is positioned so as to divide the flow of water into two streams for passage under the craft and out the stern section. As indicated in FIG. 2, the winglets 34 serve to direct the flows out the side of the stern.

Depending upon the use intended for the water craft, the runners 32 and chine 33 may be differently shaped. For example, the chine may be disposed within the plane of the runners, co-planar with the runners or below the plane of the runners. Further, the chine may have a stepped transverse cross-sectional shape in order to attain higher speeds by reducing the wetted area. However, this would reduce the load carrying ability of the craft. Also, the chine may have a saw tooth transverse cross-sectional shape defining a plurality of parallel channels for the flow of water. Such a chine would provide more stability but would increase the wetted areas thus slowing the water craft movement through the water.

Figure 3:
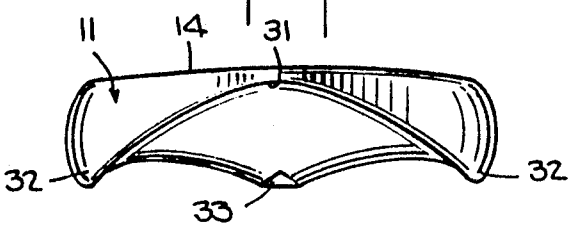
FIG. 3 illustrates a front view of the water craft of FIG. 1.

The chine 33 may also have a flat bottom surface as viewed in FIG. 3 or a rounded bottom surface. Further, the chine 33 may be symmetrically disposed between the runners 32 as indicated in FIG. 3 or may be asymmetrically disposed between the runners 32.

Still further, the chine may have a V-shaped profile of a narrow width in the bow section and a wider width in the stern section, or vice versa.

The winglets 32 are shaped so as to prevent side forces while planing which might otherwise cause a loss of control. The two winglets 34 together with a skeg (not shown) enables the sailor to shift his weight to the stern of the craft and, by placing the center of effort further astern, cause the craft to plane while penetrating small waves rather than skipping over the waves.

The runners may also be provided with different cross sectional shapes. For example, each runner may have a transverse cross-section with a flat bottom to provide load-carrying capacity. Alternatively, each runner may have a V-shaped cross-section to enhance speed. In this case, each V-shaped runner may have a vertical side wall remote from the central axis of the craft.

Also, each runner may have a V-shaped cross-section of small included angle in the bow section while having a V-shaped cross sectional of larger included angle in the stern section.

The choice of runners will determine whether the craft is to be used primarily for cruising, high speed sailing or marine rescue and patrol work. For example, flat bottom runners while offering increased load carrying capacity useful for marine rescue and patrol work also have high drag characteristics which interfere with sailing and windsurfing. Asymmetrical runners are good while sailing to windward but depress easily making them unsatisfactory for marine rescue work. V-shaped runners cannot very easily be pushed laterally through the water as long the craft remains upright. This provides reasonable performance to windward in normal cruising conditions but, if not fitted with extra or deeper fins or plates, will not go to windward if one of the runners is lifted out of the water although the various types of full V-shaped runners are good load carriers.

A steep sided narrow V runner which may be either symmetrical or asymmetrical with one side wall of the runner vertical and the other leaning inward toward the centerline of the craft is excellent for performance but, because of a little reserve buoyancy can be easily depressed. A full V-shaped runner provides a heavily rockered keel rising to a pointed bow and matched by a similarly racked shape to the stern.

A hard chine V runner may employ a chine on the underwater section of the runner. This shape is usually steep sided forward, deepening to broadly just forward of mid-craft before almost flattening out toward the stern. A hard-chine runner is a good weight carrier with moderate sailing performance.

U-shaped runners are generally round for their underwater sections. In some cases, the runner flattens out somewhat aft and the bow narrows to a fine apex at the water line so as to provide the necessary entry to cut through the surface of the water with little resistant. While fast, the U-shaped runners offer little resistance to leeway unless some extra keel or center board is attached. While U-shaped runner offer the highest overall performance, the one important limitation is that they have little reserve buoyancy and must be kept as light as possible while sailing.

In summary, for windsurfing or fixed sail modes of operation, the runners would have a U-shaped cross-section. If the craft is to be used for cruising or windsurfing, a fairly wide angled V-shaped runner would be used.

The invention thus provides a water craft of improved construction with respect to that as described in U.S. Pat. No. 4,894,035.

Further, the invention provides a water craft which is capable of multiple use and is of relatively simple construction.

Further, the invention provides a water craft which can be readily manipulated by a single person and transported between suitable storage points and points of use.

What is claimed is:

1. A water craft of board-like shape comprising a deck extending along a longitudinal axis from a bow end to a stern end of said craft;

a longitudinally disposed recess in said deck extending within said bow section and said stern section;

a pair of ridges, each ridge extending along a respective longitudinal side of said craft to define said recess thereat;

a longitudinally disposed crown in said recess; and a receptacle within said recess on said axis for receiving a mast.

2. A water craft as set forth in claim 1 wherein each ridge has a first longitudinally disposed section defining a rounded cross-section of sharp radius with said crown for receiving a heel of a windsurfer.

3. A water craft as set forth in claim 2 wherein each ridge has a second longitudinally disposed section rearward of said first section defining a rounded cross-section of large radius with said crown for seating of a rower thereagainst.

4. A water craft as set forth in claim 1 which further comprises a pair of paddle-shaped recesses in said crown for receiving a pair of oars therein, said recesses being disposed symmetrically of said axis.

5. A water craft as set forth in claim 4 wherein each paddle-shaped recess extends rearwardly under said deck at one end thereof.

6. A water craft as set forth in claim 1 which further comprises a pair of longitudinally aligned tracks on said axis within said recess for mounting of a windsurfing sail.

7. A water craft comprising a hollow body having an upraised forward bow section and a rear stern section, said bow section being of parabolic shape in transverse section with a centrally disposed recess on an underside;

a pair of depending runners extending from said bow section into and along said rear stern section;

a depending chine extending centrally of and between said runners; and a pair of winglets, each winglet extending rearwardly and outwardly from a rear end of a respective runner to direct a flow of water out a said of said stern section to enhance tracking of said body in water.

8. A water craft as set forth in claim 7 wherein said chine is disposed within the plane of said runners.

9. A water craft as set forth in claim 7 wherein said chine is a co-planar with said runners.

10. A water craft as set forth in claim 7 wherein said chine depends below the plane of said runners.

11. A water craft as set forth in claim 7 wherein said chine has a stepped transverse cross-sectional shape.

12. A water craft as set forth in claim 7 wherein said chine has a flat bottom surface.

13. A water craft as set forth in claim 7 wherein said chine has a rounded bottom surface.

14. A water craft as set forth in claim 7 wherein said chine is symmetrically disposed between said runners.

15. A water craft as set forth in claim 7 wherein said chine has a V-shaped profile of a narrow width in said bow section and a wide width in said stern section.

16. A water craft as set forth in claim 7 wherein each runner has a transverse cross-section with a flat bottom to provide load-carrying capacity.

17. A water craft as set forth in claim 7 wherein each runner has a V-shaped cross-section.

18. A water craft as set forth in claim 17 wherein each V-shaped runner has a vertical side wall remote from a central axis of said body.

19. A water craft as set forth in claim 7 wherein each runner has a V-shaped cross-section of small included angle in said bow section and a V-shaped cross section of larger included angle in said stern section.

20. A water craft as set forth in claim 7 further comprising a deck extending across said bow section and said stern section; a longitudinally disposed recess in said deck; and a pair of ridges, each said ridge extending along a respective longitudinal side of said craft to define said recess thereat and a longitudinally disposed crown in said recess.

21. A water craft as set forth in claim 20 which further comprises a receptacle in said recess for receiving a mast and wherein each ridge has a first longitudinally disposed section defining a rounded cross-section of sharp radius with said crown for receiving a heel of a windsurfer.

22. A water craft as set forth in claim 20 which further comprises a pair of paddle-shaped recesses in said crown for receiving a pair of oars therein, said recesses being disposed symmetrically of said axis and wherein each ridge has a second longitudinally disposed section rearward of said first section defining a rounded cross-section of large radius with said crown for seating of a rower thereagainst.

23. A water craft having a bow section;

a stern section;

a mid-section between said bow section and said stern section;

a forward deck section of generally flat shape in said bow section;

a recessed deck section in said mid-section;

a longitudinally disposed crown in said recessed deck section; and an angularly disposed deck section in said stern section directed rearwardly and downwardly relative to said stern section to direct a flow of water from said stern section.

24. A water craft as set forth in claim 23 wherein said mid-section has a pair of inserts for foot rests on opposite sides thereof.

25. A water craft as set forth in claim 23 wherein said stern section has a V-shaped cut-out for mounting of a steering rudder therein.

26. A water craft as set forth in claim 23 wherein each said section is hollow.

27. A water craft as set forth in claim 23 further comprising a pair of ridges, each ridge extending along a respective longitudinal side of said craft to define said recess thereat.

28. A water craft as set forth in claim 27 wherein each ridge has a first longitudinally disposed section defining a rounded cross-section of sharp radius with said crown for receiving a heel of a windsurfer.

29. A water craft as set forth in claim 27 wherein each ridge has a second longitudinally disposed section rearward of said first section defining a rounded cross-section of large radius with said crown for seating of a rower thereagainst.

* * * * *

UNITED STATES PATENT AND TRADEMARK OFFICE

CERTIFICATE OF CORRECTION

PATENT NO. : 5,127,862

DATED : July 7, 1992

INVENTOR(S) : Francesco A. Pia

It is certified that error appears in the above-identified patent and that said Letters Patent is hereby corrected as shown below:

Column 1, line 62 change "a use" to -to provide a user-
Column 3, line 12 after "order" insert -to-
Column 5, line 24 change "bridge" to -ridge-
Column 7, line 19 change "runner" to -runners-
Column 8, line 14 change "a said" to -a side- Signed and Sealed this Twenty-fourth Day of August, 1993

*Attest:*

*Attesting Officer*

BRUCE LEHMAN

*Commissioner of Patents and Trademarks*